United States Patent [19]

Sandlin et al.

[11] Patent Number: 4,459,773

[45] Date of Patent: Jul. 17, 1984

[54] TENSIONED MOUNTING DEVICE FOR THIN, PLANAR ARTFORMS

[76] Inventors: Jane M. Sandlin; William C. Sandlin, both of 1301 Baker La., Waco, Tex. 76708

[21] Appl. No.: 347,457

[22] Filed: Feb. 9, 1982

[51] Int. Cl.[3] ..... G09F 1/12

[52] U.S. Cl. ..... 40/155; 40/603; 40/611; 40/152.1; 40/156

[58] Field of Search ..... 40/156, 603, 155, 152, 40/152.1, 611

[56] References Cited

U.S. PATENT DOCUMENTS

| | | | |
|---|---|---|---|
| 1,194,610 | 8/1916 | Fischer | 40/603 |
| 2,072,754 | 3/1937 | Jones | 40/603 |
| 2,854,774 | 10/1958 | Horwitt | 40/155 |
| 3,550,297 | 12/1970 | Friedrichson | 40/603 |
| 3,589,048 | 6/1971 | Mollet et al. | 40/603 |
| 4,277,903 | 7/1981 | Crossot | 40/152.1 |
| 4,356,647 | 11/1982 | Farris | 40/155 |

FOREIGN PATENT DOCUMENTS

| | | | |
|---|---|---|---|
| 558342 | 8/1932 | Fed. Rep. of Germany | 40/603 |

*Primary Examiner*—Gene Mancene
*Assistant Examiner*—James Hakomaki
*Attorney, Agent, or Firm*—Banner, Birch, McKie & Beckett

[57] ABSTRACT

A tensioned mounting device is disclosed. The device is designed to apply a gentle tensioning force along the attached edges of a mounted thin, planar device, such as a poster. The device is comprised of two variable-length bar mechanisms. Each mechanism includes at least two frames slidably joined by a connector bar. A tensioning device, such as a spring, exerts an outward force between a frame and the connector bar.

19 Claims, 11 Drawing Figures

91
26
18
28
30
32
24
37
52
34
38
48
70
35
50
26
62
63
77
60
71
73
58
63
75
66
20
31
33
27
25
29
68

27
31
85
83
33
29
10
89
70
25

89
87
85
89
87
83

TENSIONED MOUNTING DEVICE FOR THIN, PLANAR ARTFORMS

TECHNICAL FIELD

The present invention relates broadly to artform display devices. More particularly, the invention relates to an appartus used to mount thin, planar artforms, such as posters. The apparatus applies a tensioning force to the artform.

BACKGROUND OF THE INVENTION

The use of thin, planar or sheet-like objects, such as posters and prints, as forms of art is becoming increasingly popular.

In the past decade there has been a dramatic increase in the publication of art posters, especially by museums and art galleries. The purchase of these posters as collectors' items has grown concurrently. At present the display of a poster collection poses problems that none of the current mounting devices solve completely satisfactorily.

A collector concerned with the exhibition and preservation of a poster collection confronts numerous problems. First of all, preservation of the artwork is the primary concern. Although the original cost of most art posters is modest, in time, the value may greatly appreciate, if the work is undamaged. Obvious and immediate damage results from the common practice of mounting posters with push pins or tape. Less obvious, but equally damaging is the distortion of the paper by changes in temperature and humidity. The large sheets of heavy poster paper are very susceptible to buckling and rippling that often causes permanent damage.

Posters are designed to be mounted close to the wall surface, i.e., "posted," without frame or covering. Mounting therefore should be as unobtrusive as possible and should not interfere with the aesthetic intention of the artist or designer.

Poster collecting appeals to many who cannot afford more costly artforms. Although new posters are usually inexpensive, their large size may result in framing costs that are many times the price of the poster. Also because posters are highly variable in size, the same frame can seldom be used for a variety of posters. Because of their low initial cost, collectors may buy five to ten posters annually and wish to rotate the display of their new acquisitions with older works. The large dimension of posters precludes showing more than a small part of a collection at any one time except where there is an unusual amount of wall space. Also, posters should be easily unmounted and rolled in tubes or placed in flat portfolios for safe storage.

The disadvantages of traditional devices for exhibiting posters are evident. The expense of conventional fixed dimension frames, which have little or no versatility for a variety of sizes, is an obvious drawback. Unless expertly framed, these methods may not prevent the buckling and rippling of large expanses of paper. The frequently used push pins or tape always results in permanent damage to the poster. A currently popular method of laminating posters to heavy corrugated board with a hanging mechanism attached to the back diminishes the value of the poster. In another current method of using heat-shrinkable, clear plastic covering over styrofoam backing, the poster is again susceptible to distortions caused by climatic conditions. Both lamination and shrinkwrap also present storage problems as the mounted posters require considerably more storage space. While not as expensive as traditional framing, both of the above require an expenditure for each poster purchased that is usually well over the price of the poster.

The problem of removably mounting thin, planar objects in a flat configuration has been partially solved by devices in the prior art, such as U.S. Pat. No. 3,914,892 to Mohr. In Mohr, posters or similar objects are removably inserted into a pair of width-adjustable frames with H-like clamp rods. The frames are then secured to a mounting surface. Since this mounting technique allows posters to be hung in flat configurations and readily varied, partially satisfactory results can be achieved. A problem arises, though, when ambient humidity causes the width of the mounted artform to change. The prior art devices, including Mohr, make no provisions for this width change. As a result, the internal forces of the sheet-like object cause it to ripple. This rippling is unsightly and may cause damage to the artform.

SUMMARY OF THE INVENTION

The present invention is directed to a tensioned mounting apparatus for thin, planar objects. The mounting apparatus is comprised of a pair of bar mechanisms for attachment to opposite edges of the artform. At least one of the bar mechanisms has a means for tensioning the attached edge of the object in a direction parallel to the attached edge.

In a preferred embodiment, each bar mechanism is variable in length and is comprised of a plurality of frames connected together by a connector bar. In each bar mechanism, a connector bar is attached to each end of a center frame. The position of the connector bars with respect to the center frame is adjustable to adjust the width of the bar mechanism. An outer frame is slidably carried on each connector bar and is tensionally biased away from the center frame to create a lateral tension in the attached thin, planar artform edge.

A shield is attached to the front of each bar mechanism to cover any exposed part of a connector bar when the bar mechanism is expanded. Means are provided for locking the lateral tensioning of the outer frames when the bar mechanism is being adjusted to fit the width of the artform.

The mounting apparatus of the present invention is an aesthetically satisfactory method to mount large works on paper close to the wall surface without damage to the artform. The mounting apparatus can be adjusted to fit widely varying dimensions and allows easy removal. The cost of the apparatus will be less than that of a good quality of frame, but the principle economic advantage is that it can be used for a wide variety of posters. In addition, the apparatus protects the paper from damage from humidity and temperature changes by applying a gentle lateral tensioning force along the attached edge, an innovation that prevents buckling and rippling.

Various advantages and features of novelty that characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter in which there is illustrated and described an embodiment of the invention.

DETAILED DESCRIPTION OF THE INVENTION

Figure 1:
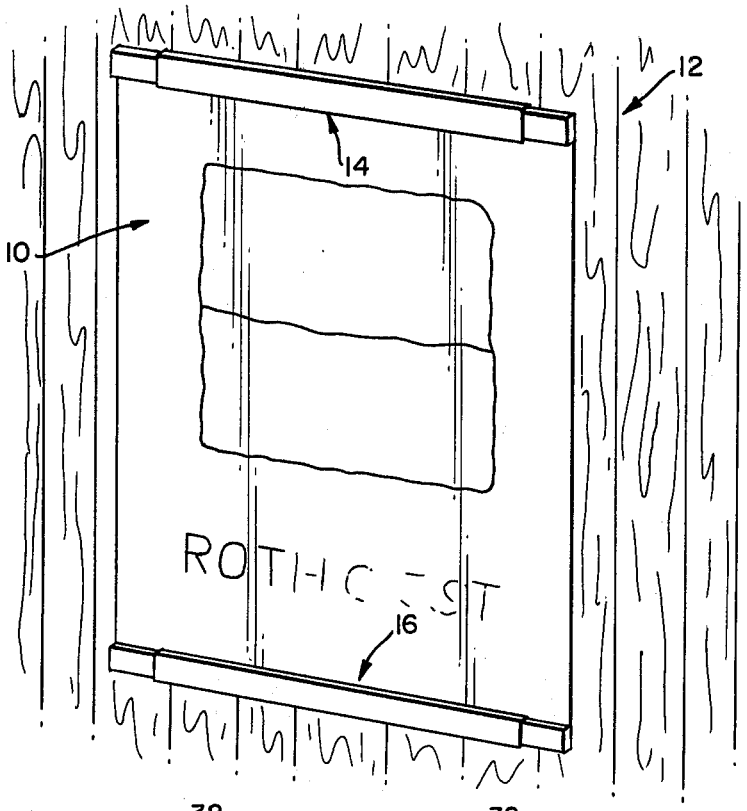
FIG. 1 is a front perspective view illustrating the present invention in use.
Figure 2:
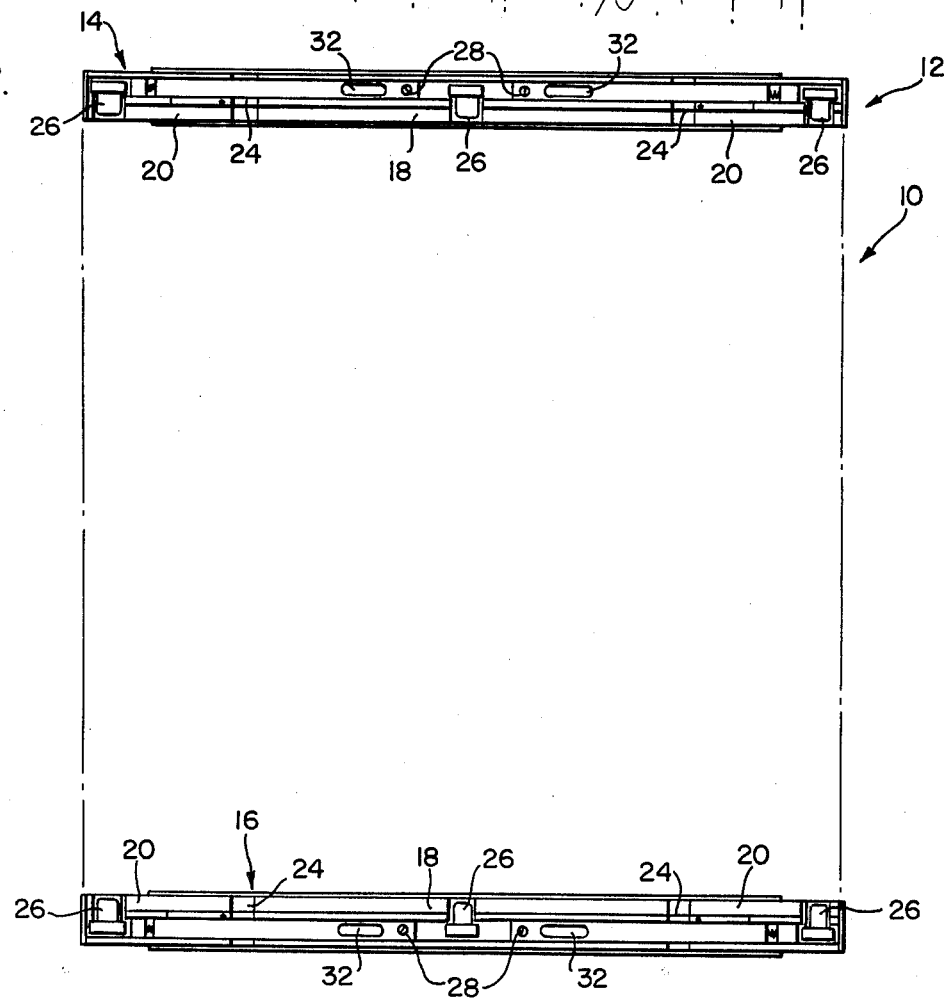
FIG. 2 is a rear elevational view illustrating the present invention in operation.
Figure 3:
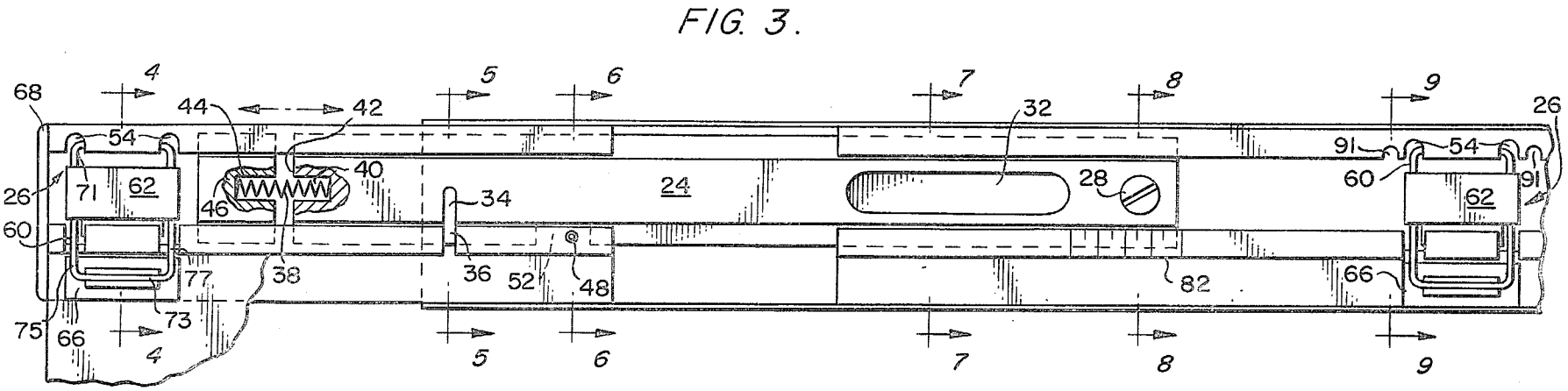
FIG. 3 is a partial rear elevational view of a portion of a bar mechanism shown in FIG. 2.
Figure 8:
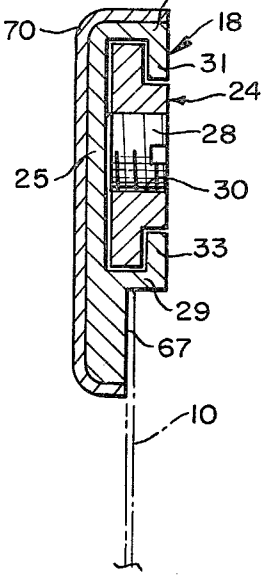
FIG. 8 is a sectional view taken generally along line 8—8 of FIG. 3.
Figure 7:
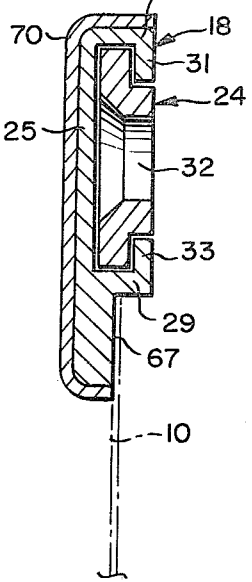
FIG. 7 is a sectional view taken generally along line 7—7 of FIG. 3.
Figure 6:
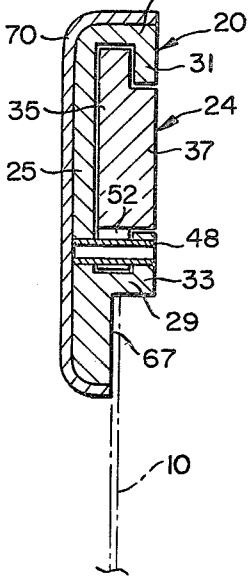
FIG. 6 is a sectional view taken generally along line 6—6 of FIG. 3.
Figure 5:
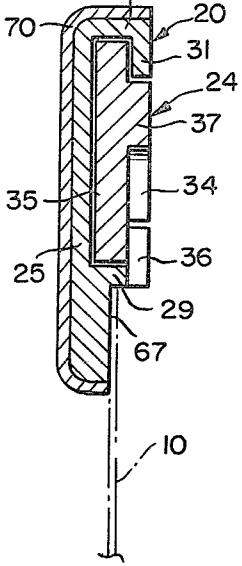
FIG. 5 is a sectional view taken generally along line 5—5 of FIG. 3.

Referring to the drawings in detail wherein like numerals indicate like elements, there is shown in FIG. 1 a sheet-like artform 10 mounted on a tension mounting apparatus 12. As seen in FIG. 2, the tension mounting apparatus 12 comprises two identical adjustable length bar mechanisms 14 and 16. In the illustrated embodiment, each bar mechanism comprises a center frame 18 and two outer frames 20. Each outer frame is connected to the center frame by a slidable connector bar 24. These frames and connector bars can be made out of any suitable material, such as wood, metal or plastic. Clamp assemblies 26 are used to attach the thin, planar artform 10 to the bar mechanism. Of course, mounting apparatus 10 could be used to mount other thin, planar objects besides artforms.

Referring to FIGS. 3-11, one side of bar mechanism 14 is illustrated in detail. Bar mechanism 16 is similarly constructed. Center frame 18 is adjustably connected to outer frame 20 by means of a telescopically slidable connector bar 24. Another connector bar 24 is connected to the other side of frame 18 in a similar manner. As seen in sectional FIGS. 4-9, center frame 18 and outer frame 20 have a generally U-shaped cross-section with a base 25, an upper arm 27 and a lower arm 29. Retaining flange 31, 33 extend inwardly toward one another from each arm 27, 29, respectively. Arms 27, 29 and flanges 31, 33 do not extend continuously along the length of each frame, however, they do define a guide channel for coupling to connector bar 24. Connector bar 24 has a generally shallow T-shaped cross-section with a base or top section 35 and a leg section 37. The top section 35 abuts the base 25 of the frames and is received within the space defined between the base 25 and each respective arm 27, 29 and flange 31, 33. The leg section 37 is received in the space defined between the inner faces of flanges 31, 33. The connector bar 24 is secured to the center frame 18 by means of an externally threaded locking screw 28 that is screwed into an internally threaded hole 30 in the connector bar 24 until its inner surface contacts center frame 18. Other conventional friction engaging mechanisms could be used to secure frame 20 to frame 18. See FIG. 8.

Adjacent the internally threaded hole 30 is a mounting slot 32. The mounting slot 32 is countersunk and machined in connector bar 24 for the purpose of engaging screws or nails attached to a mounting surface for supporting the bar mechanism 14. See FIG. 7.

Figures 9, 10, 11:
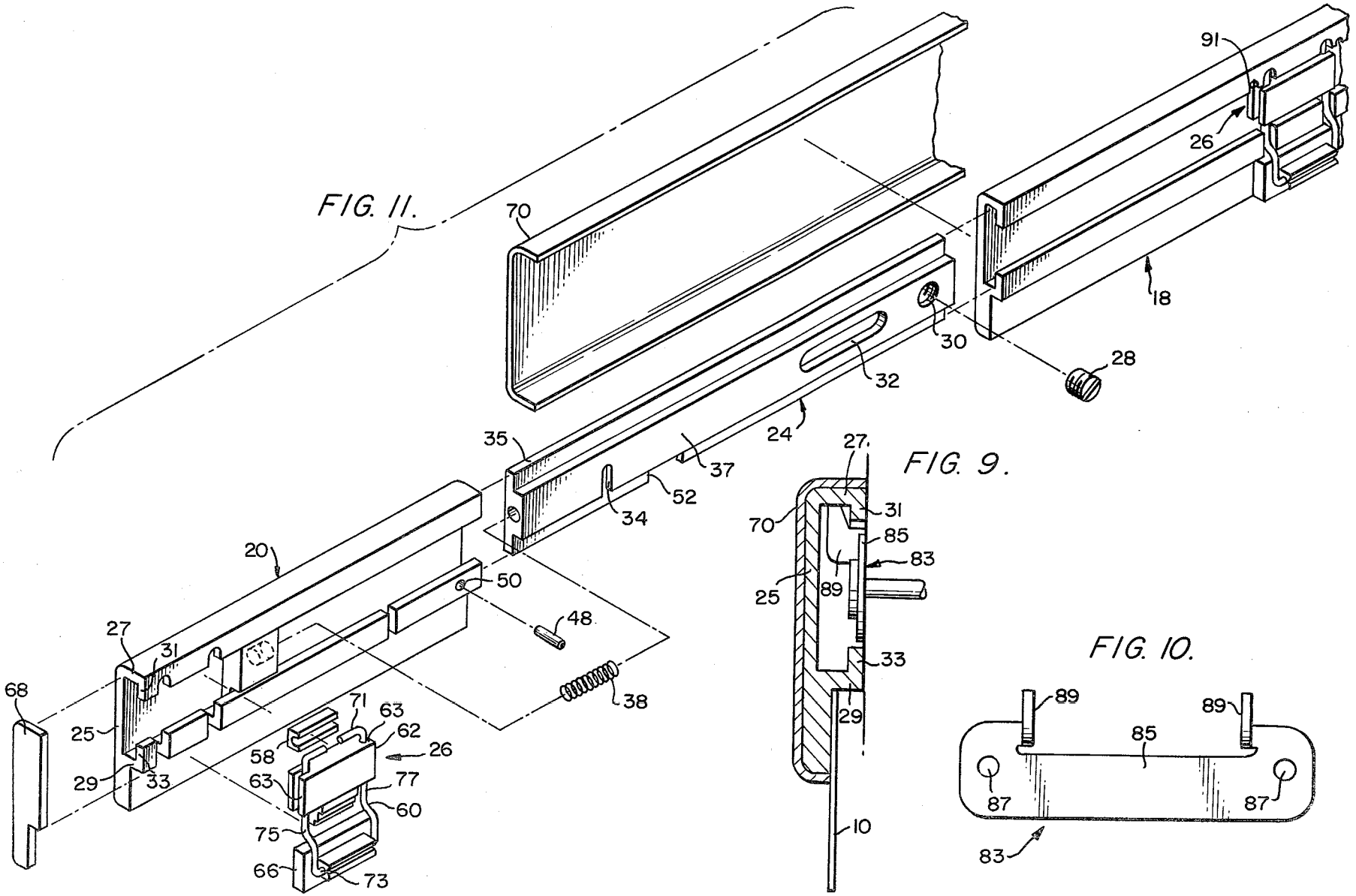
FIG. 9 is a sectional view taken generally along line 9—9 of FIG. 3.
FIG. 10 is a plane view of a mounting clip.
FIG. 11 is an exploded view of the portion of the bar mechanism shown in FIG. 3.

Alternatively, bar mechanism 14, can be attached to a mounting surface by a metal clip 83 shown in FIG. 10. Clip 83 has a base 85 through which spaced holes 87 are formed. Clip 83 is attached to mounting surface by small screws or nails which are passed through holes 87. A pair of spaced mounting fingers 89 extends perpendicularly from base 85. A pair of spaced notches 91 is formed in center frame 18. Each notch 91 receives one of the mounting fingers 89 to thereby attach bar mechanism 14 to the mounting surface.

Outer frame 20 is slidably received about the outer portion of connecting bar 24. On the outer end of connector bar 24 is a locking slot 34. A corresponding locking slot 36 is located on the outer frame 20. See FIG. 5. Located between the connector bar 24 and the outer frame 20 is a spring 38 that fits, on one end, into a spring receptacle 40 located in the adjacent edge 42 of connector bar 24. The outer side of spring 38 fits into a spring receptacle 44 of the spring retaining housing 46 located in outer frame 20. A retaining pin 48 fits into a hole 50 in the outer frame 20 and a notch 52 on the bottom of connector bar 24 to hold outer frame 20 to connector bar 24, while permitting a limited amount of sliding movement because the notch 52 has a width greater than the diameter of pin 48. Spring 38 thus biases outer frame 20 outwardly with respect to center frame 18. An end shield 68 is attached to the outer end of the frame 20 to provide a smooth end surface.

Clamp assembly 26 includes a generally rectangular shaped spring 60 on which are carried a clamp locking and release button 62 and a clamp pad 66. The spring 60 includes spaced upper and lower sections 71, 73 interconnected by spaced generally parallel upright sections 75, 77. The upright spring sections 75, 77 include a bent portion so that the upper and lower spring sections 71, 73 are located in different vertical planes. Upper spring section 71 is rotatably received within a groove in a pivot mount 58. The pivot mount 58, in turn, is carried within the space between base 25, upper arm 27 and flange 31 of outer frame 20. To allow the upper portion of upright spring sections 75, 77 to pivot outwardly, grooves 54 are formed in the arm 27 and flange 31 in alignment with spring sections 75, 77.

Figure 4:
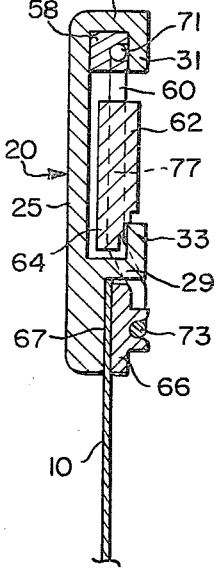
FIG. 4 is a sectional view taken generally along line 4—4 of FIG. 3.

Clamping pad 66 is pivotably supported on the lower spring section 73 by snap fitting a groove of a mounting block attached to the clamp pad 66 about the lower spring section 73. Locking and release button 62 includes a pair of spaced slots 63 to slidably mount the button 62 to the upright spring sections 75, 77. As seen in FIG. 4, button 62 has a vertical extent smaller than the distance between the ends of flanges 31, 33, so as to fit within the space defined between the flanges 31, 33 and the arms 27, 29. The lower end 64 of button 62 is ratcheted or stepped. An alignment groove 67 is formed along the lower surface of frames 18 and 20 and has a clamping surface facing clamp pad 66. An edge of the artform 10 is aligned in groove 67 and clamp pad 66 frictionally engages it. The amount of force on the artform 10 can be adjusted by placing more or less spring tension on the spring 60 by sliding button 62 to select the proper ratchet or step at the lower end 64 of button 62.

A thin shield 70 is attached to the center frame 18. This shield 70 is of such length as to cover any portion of connector bar 24 exposed when the bar mechanism 14 is extended to its greatest length. This shield can be made out of plastic, metal or any other suitable material. The shield 70 has a generally U-shaped cross-section and either frictionally fits around frames 18 and 20 or is permanently affixed to center frame 18. However, the outer frame 20 remains free to slide laterally relative to the shield 70 for the purpose of overall length adjustment and, under the force of spring 38, for accommodating any edge length changes due to fluctuations in ambient humidity.

In operation, a poster or other sheet-like artform is chosen to be mounted on a surface. The upper and lower bar mechanisms 14 and 16 are then adjusted in length to accommodate the width of the particular artform edge. This result is achieved by first aligning locking slot 34 and 36 and then placing some means of locking, such as a coin, in slots 34 and 36. This prevents the spring 38 from exerting a tension force away from the center frame 18. The sliding connector bar 24 is then telescopically adjusted within the slots of center frame 18 until the end shield 68 is lined up with the corner of the artform object. Calibration marks 82 can be placed on the mechanism 14 to aid in adjusting the width to standard measurements. Locking screw 28 is tightened against center frame 18 to lockingly secure connector bar 24 to it. Preferably, bar mechanisms 14, 16 are constructed to extend within various ranges. for example, from 16" to 20", 18" to 24", 22" to 30", etc. For hanging narrow artforms two movable outer frames 20 may not be required and the mounting apparatus 12 could be comprised of a stationary section and a single movable, i.e., under tension section. Also, bar mechanisms 14, 16 can be made in standard lengths which are not adjustable.

The edge of the artform is then placed in the positioning groove 67. Clamp assembly 26 is rotated towards outer frame 20 until clamp pad 66 firmly holds poster 10 into position in groove 67. Locking button 62 is depressed, allowing a step of lower end 64 to be properly positioned behind locking tab 65 to accommodate the artform thickness and to apply an inward spring force on pad 66. After all clamp assemblies 26 have been secured to grip the mounted sheet-like artform edge, the locking means is removed from slots 34 and 36. This allows spring 38 to expand and cause a gentle tension force to be applied to the edge of the artform in a direction parallel to the attached edge.

To attach the device to a mounting surface, mounting screws or nails are secured to the mounting surface. Slots 32 are sized wide enough so that they will slip over the head of the screws or nails. Alternatively clip 83 could be used to attach the bar mechanism. The lower bar mechanism 16, after being similarly attached to an artform, can be secured to the mounting surface. Preferably, however, the lower bar mechanism 16 is left unsecured, in which case the weight of the lower bar mechanism will cause a gentle, vertically-tensioning, gravitational force to be applied to the sheet-like object. The object will now remain in the flat configuration unaffected by ambient humidity, because the tension mounting device will allow the poster to expand or contract freely. In addition, the poster can be readily changed with other posters or artforms.

Numerous characteristics and advantages of the invention have been set forth in the foregoing description together with details of the structure and function of the invention, and the novel features thereof are pointed out in appended claims. The disclosure, however, is illustrative only, and changes may be made in detail, especially in matters of shape, size, and arrangement of parts, within the principle of the invention, to the full extent indicated by the broad general meaning of the terms which the appended claims are expressed.

We claim:

1. A tensioned mounting device for thin, planar objects comprising:

a first bar mechanism for attachment to one edge of a thin, planar object and to a support member, said first bar mechanism having an adjustable length in a direction parallel to said one edge;

a second bar mechanism for attachment to an opposite edge of a thin, planar object, said second bar mechanism having an adjustable length in a direction parallel to said opposite edge and being adapted to be suspended from the thin, planar object thereby gravitationally tensioning the thin, planar object; and each of said bar mechanisms having means for tensioning the attached edge of the object in a direction parallel to the attached edge.

2. A device in accordance with claim 1 wherein each said bar mechanism comprises:

at least two frames, each of said frames having at least one clamp assembly to secure the object to the respective frame;

said frames being connected together by a connector bar upon which said frames telescopically slide;

means for releasably securing a first of said frames to one end of said connector bar to adjust the length of said bar mechanism; and means for connecting a second end of said frames to the other end of said connector bar.

3. A device in accordance with claim 2 wherein a shield is attached to the front of said frames to cover the front of at least a portion of said frames and such portions of said connector bar as is visible from the front of said device when said bar mechanism is extended to its greatest length.

4. A device in accordance with claim 2 wherein said tensioning means includes a spring connected between said connector bar and said second frame to bias said second frame away from said first frame.

5. A device in accordance with claim 1 wherein each said bar mechanism comprises:

a center frame, a pair of outer frames and a pair of connecting bars;

each of said frames having a clamp assembly to secure the object to the respective frame;

means for releasably securing a first end of each of said connecting bars to said center frame to adjust the length of said bar mechanism; and means for connecting each of said outer frames to a respective one of said connecting bars.

6. A device in accordance with claim 5 wherein a shield is attached to said center and outer frames to cover said center frame, at least a portion of said outer frames, and such portion of said connector bars as are visible from the front of said device when said bar mechanism is extended to its greatest length.

7. A device in accordance with claim 6 wherein said connecting means includes a notch in said connecting bar, and a pin extending from said outer frame into said notch; and said notch having such location, orientation and length to allow said pin and attached frame to travel a limited distance in a direction parallel to the attached edge of the thin, planar object.

8. A device in accordance with claim 5 or 7 wherein said tensioning means includes a pair of springs, one of said springs being connected to a first of said connector bars and a first of said outer frames and the other spring being connected between the other of said connnector bars and the other of said outer frames whereby each of said outer frames is biased away from said center frame.

9. A device in accordance with claim 2 or 4 wherein said clamp assembly attached to each of said frames is comprised of:

a clamp spring, a clamp pad attached to said clamp spring, a clamp button having a clamp ratchet lock that fits into a lock retaining tab located in said frames, said button being attached to said spring, and spring mounting means for movably securing said clamp spring to said frame whereby said clamp pad is movable between a clamped position wherein the object is held to the frame and an unclamped position.

10. A device in accordance with claim 1 wherein each bar mechanism comprises:

at least two frames, each of said frames having a generally U-shaped cross-section defining a space between the legs of the U;

at least one clamp assembly attached to each of said frames to secure the object to the respective frame;

a connector bar on which said frames telescopically slide to thereby connect said frames to one another;

means for releasably securing a first of said frames to one end of said connector bar; and means for connecting a second of said frames the other end of said connector bar.

11. A device in accordance with claim 10 wherein a shield is attached to the front of said frames to cover the front of at least a portion of said frames and such portion of said connector bar as is visible from the front of said device when said bar mechanism is extended to its greatest length.

12. A device in accordance with claim 10 wherein said tensioning means includes a spring connected between said connector bar and said second frame to bias said second frame away from said first frame.

13. A device in accordance with claim 11 wherein said connecting means includes a notch through said connecting bar, and a pin extending from said second frame and into said notch, said notch having a location, orientation and length to allow said pin and attached frame to travel a limited distance in a direction parallel to the attached edge of the object.

14. A device in accordance with claim 10 wherein said clamp assembly includes:

a clamp spring, a clamp pad attached to said clamp spring, a clamp button including a clamp ratchet lock which fits into a lock retaining tab located in said frame, said button being attached to said spring; and means for movably securing said clamp spring to said frame whereby said clamp pad is movable between a clamped position wherein the object is held to the frame and an unclamped position.

15. A device in accordance with claim 14 wherein said clamp spring has a generally rectangular configuration having upper and lower sections interconnected by upright sections, said clamp pad being supported by one of said upper and lower sections, the other of said upper and lower sections being pivotably connected to said frame, and said clamp button being supported by said upright sections.

16. A tensioned mounting device for thin, planar objects comprising:

a first bar mechanism for attachment to an upper edge of a thin, planar object;

a second bar mechanism for attachment to a lower edge of the thin, planar object, said first and second bar mechanisms being totally unconnected to one another except for the attachment to the thin, planar object and the weight of said second bar mechanism providing vertical tension to the thin, planar object;

each bar mechanism including first and second frames slidably coupled to one another, each of said frames having at least one clamp assembly to secure a respective upper or lower edge to the frames;

means for biasing said slidably coupled first and second frames of each bar mechanism from one another to tension the attached thin, planar object in a horizontal direction;

means for limiting the amount of sliding motion of said slidably coupled first and second frames of each bar mechanism; and means for selectively preventing said biasing means from sliding said coupled first and second frames of each bar mechanism from one another to permit the thin, planar object to be attached to said bar mechanisms without the application of a biasing force to the thin, planar object by said biasing means.

17. A device in accordance with claim 16 wherein said limiting means includes a pin extending from one of said first and second frames and received in an elongated notch in the other of said first and second frames.

18. A device in accordance with claim 16 wherein said biasing means includes a spring supported between said first and second frames, and said selective preventing means including a first slot formed in said first frame and a second slot formed in said second frame, said first and second slots being located so that said spring is in a compressed condition when said first and second slots are aligned with one another whereby the bias of said spring is not applied to the thin, planar object by holding the first and second slots in alignment with a member inserted therein.

19. A device in accordance with claim 16 wherein one of said first and second frames includes means for adjusting the overall length of each of said bar mechanisms.

* * * * *